United States Patent [19]

Kobayashi et al.

[11] Patent Number: 4,952,977

[45] Date of Patent: Aug. 28, 1990

[54] METHOD OF OPERATING AN ELECTROPHOTOGRAPHIC COPYING APPARATUS WHEREIN ORIGINAL DOCUMENTS ARE REPLACED DURING PRELIMINARY SCANNNING, AND APPARATUS FOR CARRYING OUT THE METHOD

[75] Inventors: Chiharu Kobayashi; Masaru Ushio, both of Hachioji, Japan

[73] Assignee: Konica Corporation, Tokyo, Japan

[21] Appl. No.: 221,297

[22] Filed: Jul. 19, 1988

[30] Foreign Application Priority Data

Jul. 21, 1987 [JP] Japan ..... 62-181676

[51] Int. Cl.[5] ..... G03G 15/00

[52] U.S. Cl. ..... 355/235; 355/309

[58] Field of Search ..... 355/233-235, 355/309, 317; 271/3, 8.1

[56] References Cited

U.S. PATENT DOCUMENTS 4,129,377 12/1978 Miyamoto et al. ..... 355/317

4,264,188 4/1981 Tomosada et al. ..... 355/317 X

*Primary Examiner*—Joan H. Pendergrass

*Attorney, Agent, or Firm*—Jordan B. Bierman

[57] ABSTRACT

An electrophotographic copying apparatus is equipped with an automatic document feeder and an optical system for exposing a document by scanning. The automatic document feeder feeds and places the first original document on a platen glass table where the first document is exposed to light. The optical system exposes the first document by scanning light subsequent to a preliminary movement of the optical system. The automatic document feeder replaces the first document with the second original document, while delivering out the first document, wherein replacing the first document with the second one during the period while the optical system is carrying out the preliminary movement after exposure of the first document.

3 Claims, 4 Drawing Sheets

METHOD OF OPERATING AN ELECTROPHOTOGRAPHIC COPYING APPARATUS WHEREIN ORIGINAL DOCUMENTS ARE REPLACED DURING PRELIMINARY SCANNNING, AND APPARATUS FOR CARRYING OUT THE METHOD

FIELD OF THE INVENTION

This invention relates to an electrophotographic copying machine equipped with an automatic document feeder.

BACKGROUND OF THE INVENTION

In the case of a conventional electrophotographic copying machine with an automatic document feeder, when the automatic feeder exchanges a document sheet, the operation of the scanning exposure optical system must be stopped to await the end of the automatic document feeding operation. In this case, the machine cannot start feeding copy paper until the end of the document paper feeding operation. As a result, it takes a long time for the machine to start its exposure operation. Therefore, it was difficult to realize an electrophotographic copying machine with high efficiency, especially in the case of a machine with a long copy paper feeding path. The reason is that if copy paper feeding is started after the end of a document feeder operation, the machine must await starting the exposure while the copy paper is being carried through the long path.

SUMMARY OF THE INVENTION

While an automatic document feeder is in the operation of exchanging a document sheet, a preliminary scanning exposure operation is conducted. In the exposure operation, a signal is sent from the position sensor installed in the scanning exposure optical system. According to the signal from the sensor, the copy paper feeding operation is started. In this way, waiting time is reduced and higher efficiency is achieved.

DETAILED DESCRIPTION OF THE PREFERRED EMBODIMENTS

We will explain the present invention according to the figures as follows.

Figure 1:
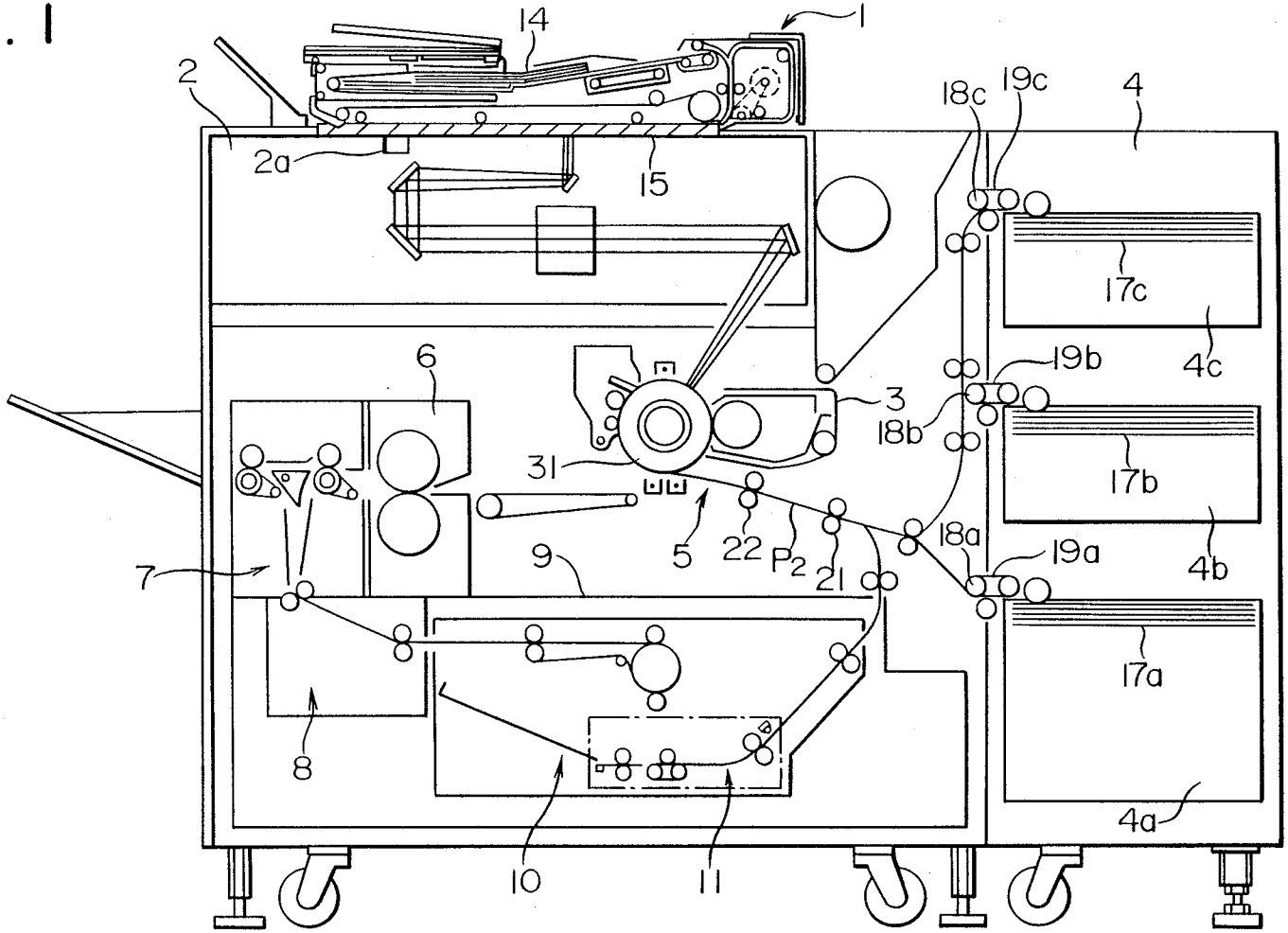
FIG. 1 shows a front view of the electrophotographic copying machine of the invention.

FIG. 1 is an outline of the front view of the electrophotographic copying machine of the present invention.

Refer to FIG. 1. The original document sheets (14) stacked on the automatic document feeder (1) are transferred to the platen glass (15) by the automatic paper feeder. The document sheet (14) on the platen glass (15) is exposed by the scanning exposure optical system (2) and an electric latent image corresponding to the document (14), is formed on the surface of the photoreceptor (31). This latent image is developed into toner image on the photoreceptor (31), by the photoreceptor image development device (3). The toner image is transferred onto copy paper, supplied by the copy paper feeder that will be described later. The toner image transferred onto copy paper is fixed by the fixing device (6). After fixing, the copy paper is discharged by the paper assist device (7).

The copy paper (17) is supplied from the copy paper feeder (4) to the photoreceptor (31). Three paper supply cassettes (4*a*~4*c*) which store three kinds of copy paper of different sizes, are installed in the copy paper feeder (4). The copy paper (17*a*~17*c*) is discharged from the paper cassettes (4*a*~4*c*) by the delivery rollers (18*a*~18*c*) and the delivery belts (19*a*~19*c*). The delivery belts (19*a*~19*c*) are set around the delivery rollers (18*a*~18*c*). The top sheet of copy paper (17*a*~17*c*) is delivered singly to the left in FIG. 1, by clockwise rotation of the delivery rollers (18*a*~18*c*), and the delivery belts (19*a*~19*c*) come into contact with the copy paper (17*a*~17*c*).

Copy papers (17*a*~17*c*) delivered by the delivery belts (19*a*~19*c*) are carried to the position P2 (Refer to FIG. 1) by the paper feeding roller (21). Copy papers are sent from the position P2 by the paper delivery roller (22) after being synchronized with the rotating speed of the photoreceptor (31), they then reach the surface of the photoreceptor and the toner image is transferred onto them. The timing required for the delivery of the copy paper (17*a*~17*c*) by the paper delivery roller (22) will be described later with FIG. 2.

Line speed (circumferential speed) of the photoreceptor (31) is set at the same as that of the delivery speed of the copy paper (17*a*~17*c*) that is owing to the speed of the delivery roller (18*a*~18*c*) and the delivery belt (19*a*~19*c*). Therefore, the speed of the delivery rollers (18*a*~18*c*), the delivery speed of the copy paper (17*a*~17*c*) due to the delivery belts (19*a*~19*c*), and the carrying speed of the copy paper (17*a*~17*c*) that is due to the paper feeding roller (21) and the paper feeding roller (22), are altered in accordance with the line speed change caused by enlargement and reduction. In this case the line speed is the same as the circumferential speed of the photoreceptor.

In the case of a one sided copy, the image is fixed by the fixing device (6) and then the copy paper is discharged from the machine by the reverse discharge paper changeover device (7). Thereby the operation is finished. In the case of a double sided copy, copy paper is fed again as follows.

The reverse discharge changeover device (7) is installed in the lower stream (the left side of FIG. 1) of the copy paper carrying device (5). The reverse discharge changeover device (7) is able to choose the path of the fixed copy paper, between either going straight, (the left side in FIG. 1) to discharge it from the machine, or going to the switching means (8) to copy both sides.

Copy paper (17) sent to the lower part of the machine (FIG. 1) through the reverse discharge changeover device (7) is delivered to the reverse carrying device (9), after being guided by the switching means (8). The copy paper (17) delivered to the reverse carrying device (9) is carried clockwise and reversed here. After being reversed, copy papers (17) are piled on the stacker (10) that is installed in the lower part of the reverse carrying device (9), and they are then sorted. After that, the bottom sheet of the copy paper in the stack is driven by the paper feeding device (11) and delivered. This sheet of paper (17) is delivered to the copy paper carrying device (5). After that, the image is transferred onto this sheet of paper by the photoreceptor image development device (3) in the same way as the one sided copy stated above, fixed by the fixing device (6), and discharged from the machine through the reverse discharge changeover device (7). In this way, reverse photocopy on the first sheet of copy paper has been carried out by feeding it twice. When the next start signal is input into the device, the machine starts the copying of papers (17) that are waiting on the paper feeding device (11). After that the paper feeding motion stated above is repeated.

EXAMPLE 1

The timing required to exchange the document sheet (14) in the automatic document feeder (1), and that to deliver the copy paper (17) are explained together with FIG. 2, as follows:

The timing required to exchange the document sheet in the automatic document feeder can be decided by preliminary scanning in the scanning exposure optical system. Preliminary scanning will be explained later. FIG. 2 explains how the first two sheets of document (14) are copied, in a case where not less than two sheets of document (14) are copied to get two sheets of copy per each document. This diagram shows that preliminary scanning is carried out after the first and second copies of the first sheet of the document (14) have been taken, and that during this preliminary scanning the first sheet of the document (14) is exchanged with the second sheet of the document (14), and that the first copy of the second sheet of the document (14), (the third one from the beginning), and the second copy of it are taken.

Exchange of the document sheet (14) can be conducted by the automatic document feeder (1) while the scanning exposure optical system (2) is carrying out the preliminary scanning. Accurate motion of the scanning exposure optical system (2) can be realized by keeping the reciprocating motion of the scanning exposure optical system (2) continuous.

Concerning the timing of delivery of the copy paper (17) from the paper feeding roller (22), its motion is synchronized with the rotation of the photoreceptor (31). This synchronized motion is conducted by the signal from the position sensor (2*a*) that is installed in the scanning exposure optical system (2). Travel position of the scanning exposure optical system (2) is detected by the position sensor (2*a*). The position of the scanning exposure optical system (2) which travels back after exposure, is detected by the position sensor (2*a*). In this way the timing, to deliver the copy paper (17) by the paper feeding roller (22) is decided.

The signal detected by the position sensor (2*a*) when the scanning exposure optical system (2) returns after the exposure process, is used to decide the timing of the paper feeding roller (18) to deliver the copy paper (17*a*~17*c*) as well as the timing of the paper feeding roller (22).

Figure 2:
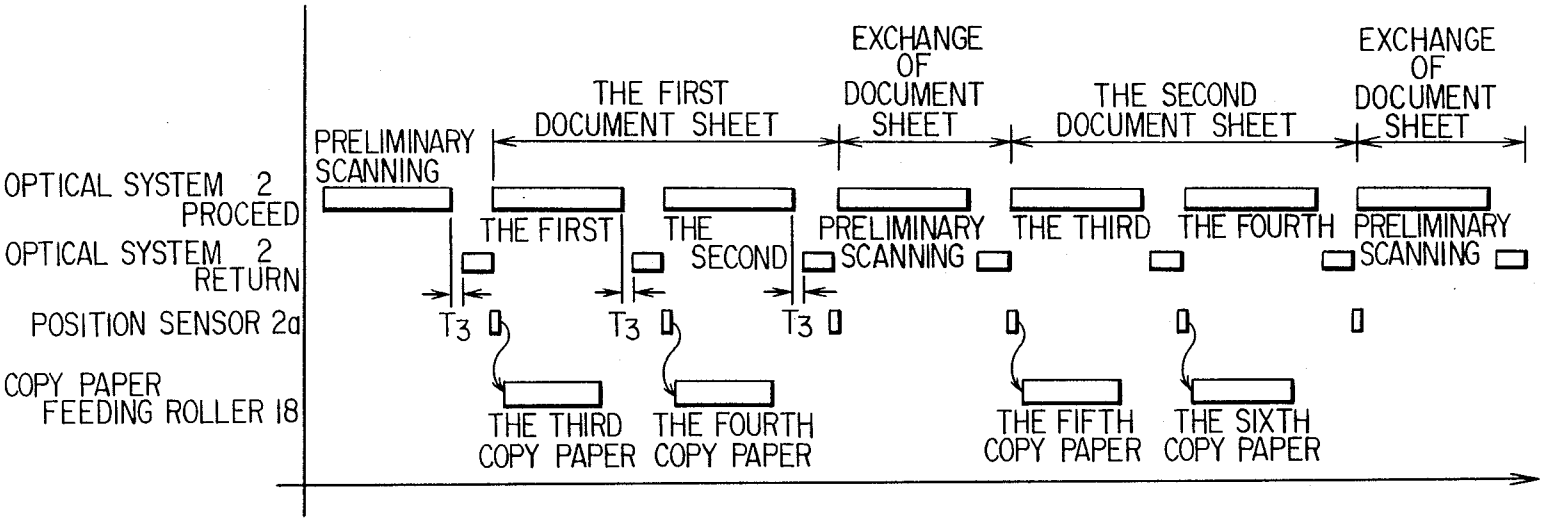
FIG. 2 is a time chart that explains one operation of the electrophotographic copying machine of this invention.

The paper feeding roller (18) starts rotating according to the signal detected by the position sensor (2*a*) as shown in FIG. 2. Then the paper feeding roller (18) stops rotating after fixed time has passed. The copy paper (17) is delivered to the left in FIG. 1, being driven by the paper feeding roller (18). FIG. 2 shows the delivery timing of only the third copy paper (17) and the following copy paper from the paper feeding roller (18). But the first and second copy papers are delivered forcefully by the paper feeding roller (18) when the power switch is turned on or the copy paper size selection switch is handled. In order to make the delivery intervals of the copy paper (17) equalize, the following copy paper delivery starts after the scanning exposure optical system (2) conducts the preliminary scanning prior to forming the latent image on the photoreceptor (31).

Consequently the timing required for the third copy paper delivery from the paper feeding roller (18) is due to the signal from the position sensor (2*a*). In this case, the signal is sent from the sensor (2*a*) when it has detected the returning position of the scanning exposure optical system (2) after the preliminary scanning. Then the timing required for the fourth copy paper (17) delivery is due to the signal from the position sensor (2*a*). In this case the signal is sent from the sensor when it has detected the returning position of the scanning exposure optical system (2) after it has completed exposure of the first document sheet. In a case wherein the scanning exposure optical system (2) has returned after the preliminary scanning to exchange the document sheet by the automatic document feeder (1), the delivery of the copy paper (17) from the paper feeding roller (18) and the paper feeding roller (22), is not conducted.

The lengths of the paths from the cassettes (4*a*~4*c*) to the position P2 are different from each other. It depends on the cassette. Therefore the delivery intervals of the copy paper (17*a*), (17*b*), and (17*c*) are different from each other.

The timing required for the delivery of the copy paper (17) from the paper feeding roller (18*a*)~(18*c*) is adjusted according to the delayed signal from the position sensor (2*a*) by using a timer.

As described above, the cycles of the copy paper (17*a*)~(17*c*) delivery are decided according to the reciprocating movement of the scanning exposure optical system (2). The timing required for the copy paper (17*a*)~(17*c*) delivery to the photoreceptor (31) by the paper feeding roller (22), is also decided according to the movement of the scanning exposure optical system (2). Furthermore, the brake position of the scanning exposure optical system (2) in the returning stroke, and the stop position of the system are decided by the reciprocating movement. Consequently, the speed and the position of the scanning exposure system (2) during its reciprocating movement must be accurate. That is the reason why the reciprocating speed of the scanning exposure optical system (2) must be controlled accurately as shown in the time chart in FIG. 4.

Figure 4:
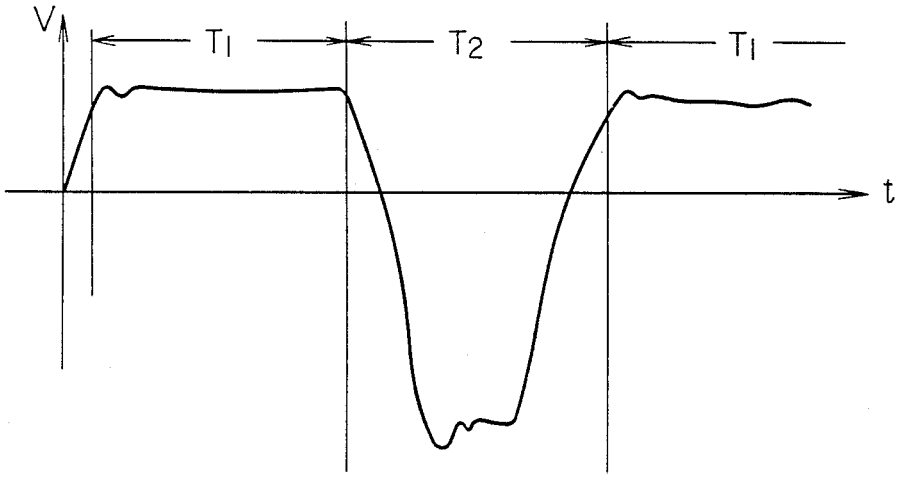
FIG. 4 is a time chart that explains the operation of the electrophotographic copying machine of this invention.

In FIG. 4, the scanning exposure optical system (2) proceeds during the period T1. While it proceeds, the scanning exposure optical system (2) exposes the document sheet (14) and the latent image is formed on the photoreceptor (31) responding to the document sheet (14) as described above. Therefore, the travel speed of the scanning exposure optical system (2) must be constant to avoid unevenness of density of the image. Therefore integral-mode control is conducted during the period T1. Integral-mode control has the disadvantage that the response speed is slow. On the other hand, high accuracy is achieved by integral-mode control since the set speed (In this case, the travel speed of the scanning exposure optical system is meant.) precisely corresponds to the actual speed.

The scanning exposure optical system (2) returns during the period T2. It is preferable to make the scanning exposure optical system (2) return at a high speed to increase the efficiency of the electrostatic copying machine since the exposure of the document sheet (14) is not conducted in the return stroke. But as described above, the cycle of the scanning exposure optical system (2) reciprocating movement must be accurate. So a mere high speed return motion of the scanning exposure system (2) would cause dispersion of both the travel speed and the stop position of the system. Therefore, proportional control is conducted in the period T2. Proportional control has the disadvantage that the travel speed of the system is a little slower than the set speed. In this case, the speed means the travel speed of the scanning exposure optical system (2). On the other hand, it has the advantage that the response speed is high and the position is controlled acurately. The travel speed and position of the scanning exposure optical system (2) are controlled very accurately by integral-mode control in proceeding motion and by proportional control in returning motion.

The travel speed control of the scanning exposure system (2) causes an inconvenience in the document sheet exchange movement by the automatic document feeder (1) and in the preliminary scanning movement by the scanning exposure optical system (2). The inconvenience is explained as follows.

In a case whereby the automatic document feeder (1) has the function of exchanging not only a one sided document (14) but a double sided document sheet (14), the time needed to exchange the double sided document sheet (14) is longer than that needed to exchange the one sided document sheet (14). In a case of a double sided document sheet, longer time is needed in order to reverse the document sheet. The time needed to exchange the document sheet (14) by the automatic document feeder (1) is created by the preliminary scanning movement of the scanning exposure optical system (2).

Therefore, a reduction of the travel speed of the scanning exposure optical system (2) could be one of the countermeasures to increase the efficiency. But the speed control by both the integral-mode control method and the proportional control method is conducted in the machine, so the control system will become complicated if the control mode to reduce the travel speed of the scanning exposure optical system (2) is added to the speed control system.

In the invention, the scanning exposure optical system (2) is awaited during the time T3 (FIG. 2) when the scanning exposure optical system (2) transits from a proceeding stroke to a returning stroke. This waiting time is adjusted to compensate for the longer exchange time needed to reverse the double sided document sheet (14).

EXAMPLE 2

One of the operation of the electrophotographic copying machine of this invention is explained above. Then another operation of this machine is shown as follows that explains the timing for exchange of the document sheet (14) in the automatic document feeder (1) and the timing for delivery of the copy paper (17) according to FIG. 3.

Figure 3:
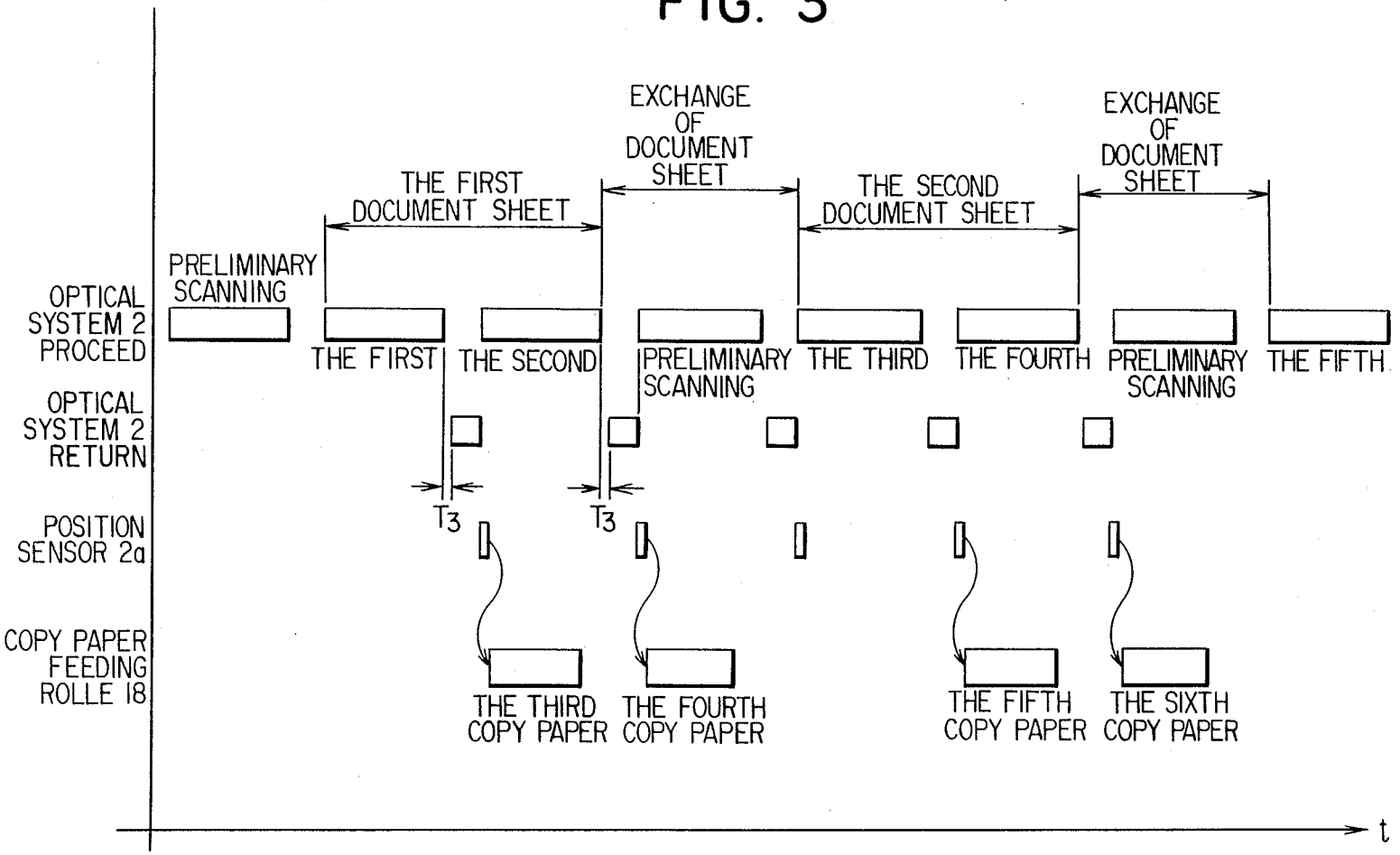
FIG. 3 is a time chart that explains the other operation of the electrophotographic copying machine of this invention.

In this case as shown in FIG. 3, the timing required to exchange the document sheet (14) in the automatic document feeder (1) can be decided by the signal of the end of the proceeding motion of the scanning exposure optical system (2). FIG. 3 explains how the first two sheets of document (14) are copied, in a case where not less than two sheets of document (14) are copied to get two sheets of copy per each document. This diagram shows that after the first copy of the first sheet of the document (14) has been taken, the scanning exposure optical system (2) proceeds to expose the first sheet of the document sheet (14) to take the second copy. A signal can be taken at the end of proceeding motion of the scanning exposure optical system (2). Then the first sheet of the document sheet (14) is exchanged with the second one in the automatic document feeder (1) according to the signal.

The reason why the exchange of the document sheet (14) is conducted by the automatic document feeder (1) right after the proceeding motion of the scanning exposure optical system (2), in other words right after exposure, is the exchange of the document sheet (14) causes no problem since exposure of it has already been conducted. The scanning exposure optical system (2) returns after proceeding motion followed by waiting time (T3). After the returning motion of the scanning exposure optical system (2), the system (2) conducts a preliminary scanning motion. The FIG. 3 shows the exchange of the document sheet (14) is being conducted by the automatic document feeder (1) while the preliminary scanning motion is carried out by the scanning exposure optical system (2). At the end of returning motion, the copy paper (17) is delivered by the delivery roller (18) according to the signal from the position sensor (2*a*). The position of the scanning exposure optical system (2) which travels back after exposure motion, is detected by the position sensor (2*a*). The signal from the position sensor (2*a*) is used to decide the timing to deliver the fourth copy paper (17) by the paper delivery roller (18). This signal of the position sensor (2*a*) is utilized not only for the delivery roller (18) but for the paper feeding roller (22) when it starts in order to deliver the copy paper (17).

FIG. 3 shows the timing of the copy paper delivery by the delivery roller (18) to send the third copy paper (17) and the following copy papers. But the first and second copy papers are delivered by the paper feeding roller (18) according to the signal from the timer which is actuated when the power switch is turned on or the copy paper size selection switch is handled. Preliminary scanning is also started according to the signal from the timer.

Consequently, the timing for the paper feeding roller (18) to deliver the third copy paper (17) is decided by the signal from the position sensor (2*a*). This signal is sent when the scanning exposure optical system (2) returns after proceeding motion to expose the document sheet (14). When the scanning exposure optical system (2) returns after exposure motion for the second copy of the first document sheet, its position is detected by the position sensor (2*a*) and the signal is sent from the sensor to the copy paper feeding roller (18) to deliver the copy paper (17). The delivery timing for the fourth copy paper (17) is decided in this way. When the scanning exposure optical system (2) returns after preliminary scanning motion to exchange the document sheet (14) by the automatic document feeder (1), copy paper delivery by the paper delivery roller (18) and paper feeding roller (22) is not conducted.

In the electrophotographic copying machine of this invention, the copy paper feeding operation is conducted according to the travel movement of the scanning exposure optical system (2). In this way, even in electrophotographic copying machines in which the copy paper (17) is delivered according to the signal due to the movement of the scanning exposure optical system (2), the document sheet (14) can be exchanged in the automatic document feeder (1) without the operation stoppage of the scanning exposure optical system (2).

What is claimed is:

1. An electrophotographic copying apparatus comprising a document handling means for feeding a document onto a platen glass and carrying the document away from said platen glass;

a scanning means having a light source and adapted to carry out sequentially a preliminary scanning and an exposure scanning along said platen glass, thereby irradiating the document during said exposure scanning and projecting reflected light from the document onto a moving image forming means;

said image forming means forming a copy image in response to the reflected light;

a paper feeding means for feeding copy paper to said image forming means;

a control having a sensing member for detecting a movement of said scanning means and for controlling the operation timing of said paper feeding means based on the detection result of said sensing member;

said document handling means adapted to replace the irradiated document with a fresh document; and said controlling means further controlling said scanning means to perform said preliminary scanning so that said preliminary scanning is carried out during the replacement of the documents by said document handling means.

2. The apparatus of claim 1 wherein said control has a timer which provides a waiting time between a preceding stroke and a returning stroke in a reciprocation of said preliminary scanning during replacement of the documents, said control adjusting said waiting time in accordance with the document to be replaced.

3. A method of exchanging original documents in an electrophotographic copying apparatus equipped with an automatic document feeder and an optical system for exposing said document, said method comprising (a) feeding and placing a first original document on a platen glass table and exposing said first document to light, (b) said exposing comprising scanning the light subsequent to a preliminary scanning of said optical system, (c) replacing said first document with a second original document, while discharging the first document, and replacing said first document with said scanning document during a second said preliminary scanning which occurs after exposure of said first document.

* * * * *